United States Patent [19]

Schreiber

[11] Patent Number: 4,497,138

[45] Date of Patent: Feb. 5, 1985

[54] APPARATUS FOR SIMULTANEOUSLY GRINDING INNER AND OUTER WORKPIECE SURFACES

[75] Inventor: Jürgen Schreiber, Wetzlar, Fed. Rep. of Germany

[73] Assignee: Buderus Aktiengesellschaft, Wetzlar, Fed. Rep. of Germany

[21] Appl. No.: 555,433

[22] Filed: Nov. 25, 1983

Related U.S. Application Data

[63] Continuation of Ser. No. 318,259, Nov. 4, 1981, abandoned.

[30] Foreign Application Priority Data

Nov. 5, 1980 [DE] Fed. Rep. of Germany ..... 3041663

[51] Int. Cl.[3] ..... B24B 7/00

[52] U.S. Cl. ..... 51/3; 51/73 R; 51/181 NT

[58] Field of Search ..... 51/52 R, 73, 3, 181; 269/287, 288

[56] References Cited

U.S. PATENT DOCUMENTS

| | | | |
|---|---|---|---|
| 2,142,020 | 12/1938 | Dunbar et al. . | |
| 2,291,268 | 7/1942 | Wigglesworth | 51/3 |
| 2,344,242 | 3/1944 | Flygare et al. | 51/3 |
| 2,807,916 | 10/1957 | Squire et al. | 51/3 X |
| 3,038,734 | 6/1962 | Else | 269/287 X |
| 3,430,388 | 3/1969 | Gabrielli | 51/3 |

FOREIGN PATENT DOCUMENTS

| | | |
|---|---|---|
| 1695503 | 3/1955 | Fed. Rep. of Germany . |
| 1502005 | 5/1969 | Fed. Rep. of Germany . |
| 505754 | 9/1970 | Fed. Rep. of Germany . |
| 2911345 | 9/1979 | Fed. Rep. of Germany . |
| 494618 | 9/1970 | Switzerland . |

OTHER PUBLICATIONS

"Maschinensysteme-eine Rationalisierungsmoglichkeit in der Einzel-und Kleinserienfertigung", *Industrie Anzeiger*, Dr. Ing. Beckenbauer, pp. 370-374, 1972.

*Primary Examiner*—E. R. Kazenske
*Assistant Examiner*—Willmon Fridie, Jr.
*Attorney, Agent, or Firm*—Karl F. Ross; Herbert Dubno

[57] ABSTRACT

A grinding apparatus comprises a base, a chuck on the base for supporting a workpiece for rotation about an axis, a first on the base to one axial side of the chuck for grinding an internal surface of the workpiece in the chuck, a second grinder on the base for grinding an external surface of the workpiece in the chuck, and fasteners for retaining the grinders releasably on the base adjacent the chuck. Thus both axial sides of the workpiece remain exposed for machining both ends of the workpiece simultaneously. The chuck is of the centerless type which engages the workpiece externally on its outer diameter between its ends, thereby leaving these ends free for grinding.

3 Claims, 7 Drawing Figures

APPARATUS FOR SIMULTANEOUSLY GRINDING INNER AND OUTER WORKPIECE SURFACES

This application is a continuation of application Ser. No. 318,259 filed Nov. 4, 1981 now abandoned.

FIELD OF THE INVENTION

The present invention relates to a grinding apparatus. More particularly this invention concerns such an apparatus used for simultaneously grinding internal and external surfaces of a workpiece such as a journal, gear, or the like.

BACKGROUND OF THE INVENTION

In the machining of machine parts such as gears, journals, and the like it is obviously very important to machine them with surfaces that conform absolutely to the desired shape, whether this be with respect to a plane, a center of curvature, or an imaginary nonplanar curve. Normally the various grinding or machining tools act on the workpiece sequentially, that is the workpiece is moved from tool to tool. In addition it is standard practice to rechuck the workpiece for each different tool. Although it is possible to rechuck with considerable accuracy, such an operation wastes time, and the small errors created with each rechucking are cumulative, leading frequently to an unacceptable total deviation from the desired shape.

Accordingly it has been suggested in German patent document No. 2,911,345 filed by M. Onoda, Y. Nakajima, and S. Iwata with a claim to a Japanese priority date of Mar. 22, 1978 to provide inner-surface and outer-surface grinders immediately adjacent one another on a common machine bed. An annular workpiece can thus be machined on both its inner and outer surfaces simultaneously by this machine.

The problem with this type of arrangement is that many workpieces, such as tubular shaft journals, not only must be machined internally and externally, but this machining must be done at both ends. Thus even in the system described in this German patent document it is necessary to dechuck, reverse, and rechuck the workpiece. This process similarly increases the likelihood of misplacing the workpiece and machining it in a later step about a center that differs from that about which the machining took place in the earlier step.

OBJECTS OF THE INVENTION

It is therefore an object of the present invention to provide an improved grinding apparatus.

Another object is the provision of such a grinding apparatus which overcomes the above-given disadvantages.

Yet another object is to provide a grinding apparatus capable of working on several workpiece surfaces without having to rechuck the workpiece.

SUMMARY OF THE INVENTION

These objects are attained according to the instant invention in a grinding apparatus comprising a base, chuck means on the base for supporting a workpiece for rotation about an axis, first grinder means on the base to one axial side of the chuck means for grinding an internal surface of the workpiece in the chuck means, second grinder means on the base for grinding an external surface of the workpiece in the chuck means, and securing means for retaining the grinder means releasably on the base adjacent the chuck means.

Thus with the system according to the instant invention both axial sides of the workpiece remain exposed for machining both ends of the workpiece simultaneously. The chuck means is of the centerless type which engages the workpiece externally on its outer diameter between its ends, thereby leaving these ends free for grinding.

According to further features of this invention, slide means is provided for displacing the chuck means relative to the grinder means. Thus it is possible to replace, for instance, the inside grinder with a planer and simultaneously finish both ends of a workpiece.

The chuck means according to this invention can include a hydraulic bearing supporting the workpiece. Such a bearing allows the workpiece to rotate about its axis rapidly with no appreciable deviation from the center of rotation defined by the chuck.

Both of the grinder means of the system of the instant invention lie to the side of the chuck means. The apparatus can then have second such first and second grinder means to the other axial side of the chuck means.

In accordance with another feature of the invention, both of the grinder means are to the one side of the chuck means and each has a grinding tool having a surface engaging the workpiece at a point and moving at the point oppositely to the workpiece at the point, the tools being oppositely rotated. This manner of operation insures fastest possible material removal with minimal strain on the workpiece or chuck rotating it.

DESCRIPTION OF THE DRAWING

The above and other features and advantages will become more readily apparent from the following, reference being made to the accompanying drawing in which.

SPECIFIC DESCRIPTION

Figure 1:
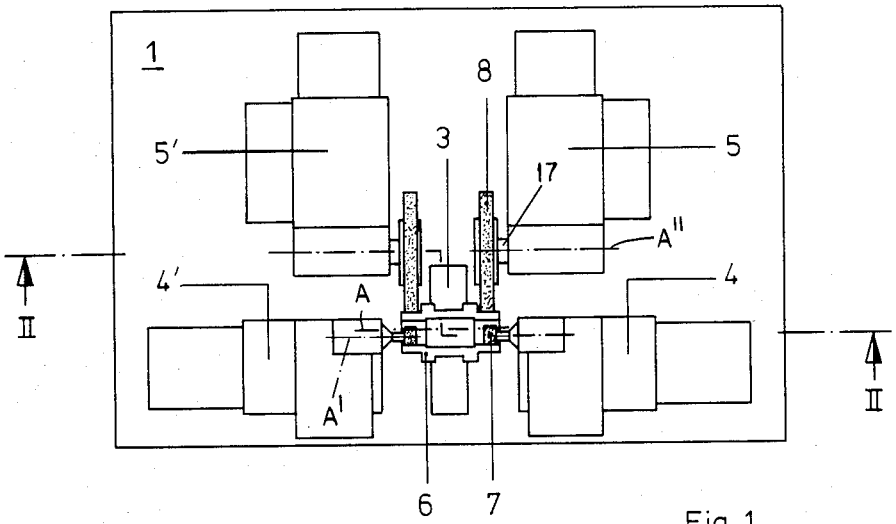
FIG. 1 is a top view of a first embodiment of the apparatus according to the instant invention.
Figure 2:
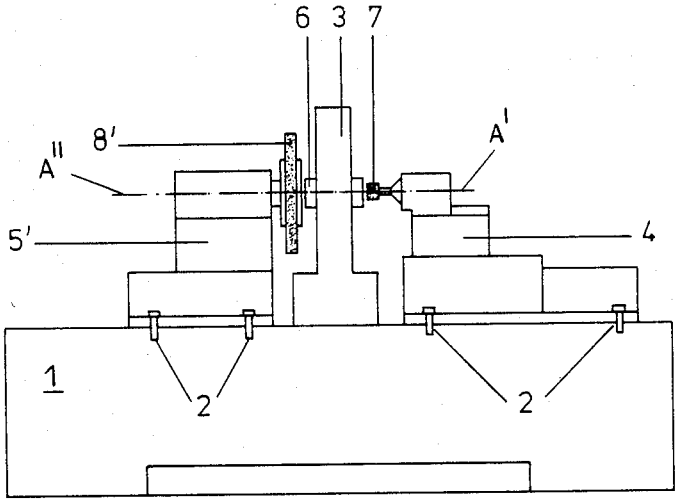
FIG. 2 is a section taken along line II—II of FIG. 1.

As seen in FIGS. 1 and 2 a common bed 1 carries a pair of inner-surface grinders 4 and 4' and a pair of outer surface grinders 5 and 5' secured to the bed 1 by means of screws 2 so they can be removed and moved about on the bed 1. A centerless-type chuck 3 supports a workpiece 6, here a tubularly cylindrical journal, for rotation about an axis A between the two sets of grinders 4–5'.

Figure 4:
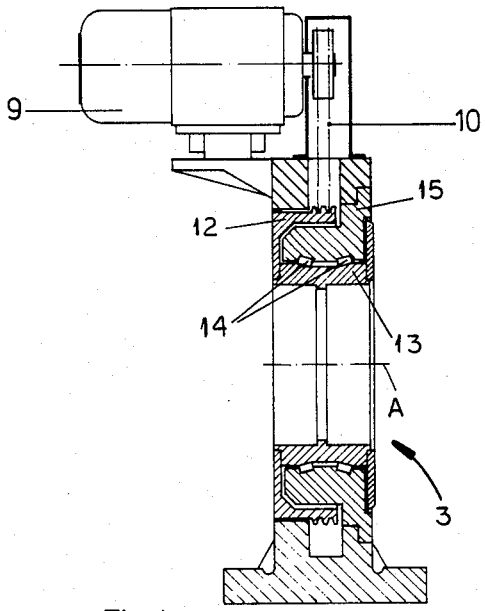
FIG. 4 is a vertical section through a detail of FIG. 1.

This chuck 3 comprises, as shown in FIG. 4, an electric drive motor 9 connected via belts 10 to a pulley 12 carried on a holder ring 13 supported by roller bearings 14 for rotation about the axis A inside an outer fixed chuck part 15. The workpiece 6 is fitted into this holder ring 13 and held rigidly therein by means of an appropriate double-membrane chuck insert that has a chamber that can be pressurized hydraulically as is well known to the person skilled in the centerless-grinding art. With such a chuck it is possible to hold radial deviations of the workpiece 6 from the axis A to below 1 micron.

The inner-surface grinders 4 and 4' each have an electric drive motor whose output shaft is connected through a gear transmission to a shaft 16 carrying a grinding cup 7 rotatable about its center axis A' which is offset from but parallel to the workpiece axis A. Similarly the outer-surface grinders 5 and 5' each have an electric drive motor whose output shaft is connected through a gear transmission to a shaft 17 carrying a standard disk grinding wheel 8.

Figure 5:
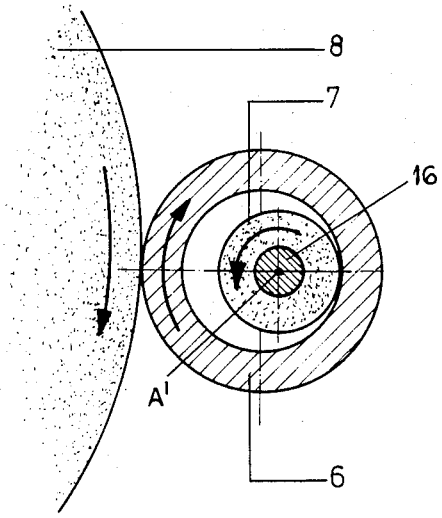
FIG. 5 is a large-scale view of another detail of FIG. 1.

FIG. 5 shows how the inner tools 7 are rotated about their axes A' in a direction opposite that of the workpiece 6 about its axis A. The tools 8 are rotated in the opposite direction to both the workpiece 6 and tools 7. Thus at the location where each tool 7 or 8 engages the workpiece 6 it is moving in the opposite direction to this workpiece 6. As a result of this large speed differential it is possible to remove material at a high rate.

Figure 3:
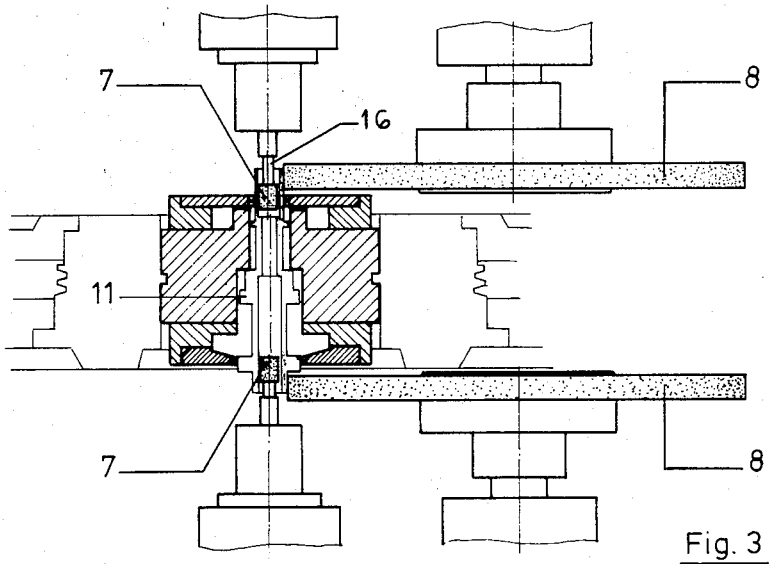
FIG. 3 is a large-scale view of a detail of FIG. 1.

FIG. 3 shows the simultaneous inner and outer grinding of a gear block 11. This block 11 is held on both sides by roll cages which are provided with a bore and held on rollers guided by wires in turn secured in a brass ring. Accurately grinding such a workpiece 11 when it is to be used in a transmission ensures quiet running and a long service life of the transmission.

Figure 6:
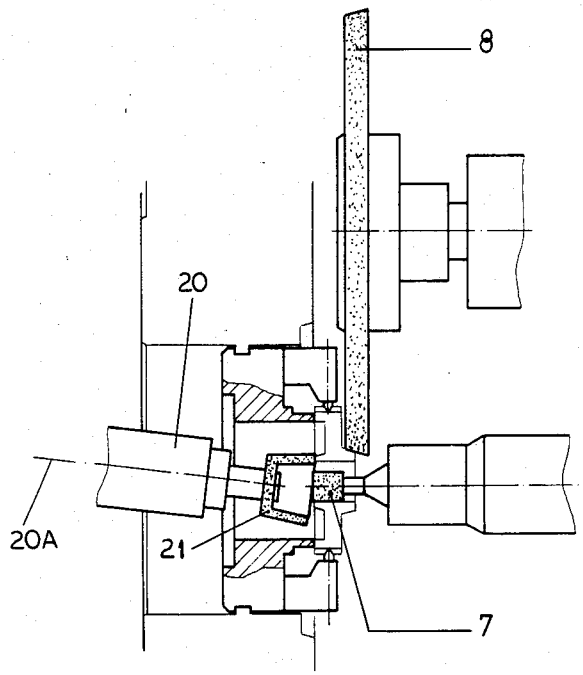
FIG. 6 is a detail view of a second embodiment of the apparatus according to this invention.

FIG. 6 shows simultaneous grinding both of an internal surface and of end surfaces which are to be ground plane and flat. To this end the apparatus has an outer-surface grinder 20 with a cup wheel 21 rotatable about an axis 20A intersecting the axis A at an acute angle. In this arrangement, as in all the others, the bed 1 is a heavily built welded structure, and the various grinder mounts are of cast iron, so that the entire arrangement is very rigid.

Figure 7:
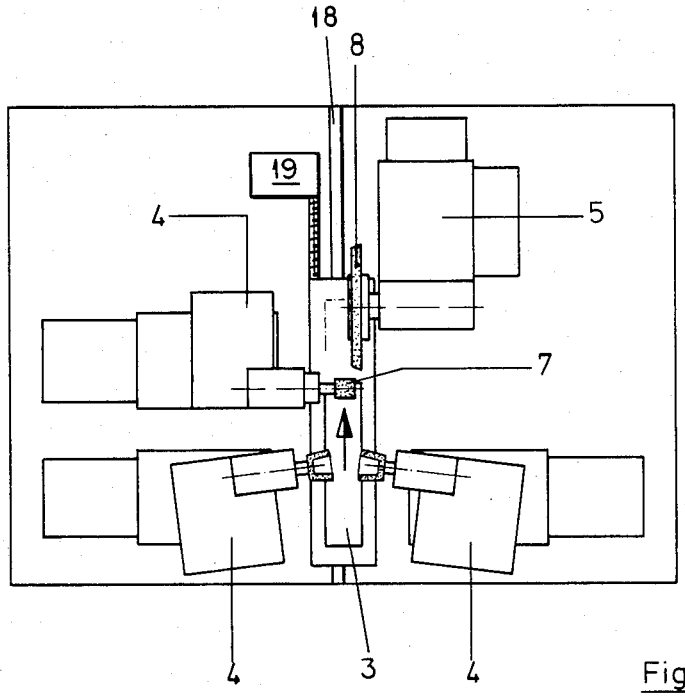
FIG. 7 is a top view of a third embodiment of the apparatus of the invention.

FIG. 7 shows an arrangement wherein two such outer-surface grinders 20' and 20'' are employed, offset from a single grinder 4 and a single grinder 5 of the type described with reference to FIG. 1. Here the chuck 3' is mounted in a slide slot indicated at 18 and means indicated schematically at 19 is provided for displacing the chuck 3 along the bed 1. Thus this machine can be used for sophisticated surface milling or planing also. In this type of arrangement, the chuck 3' is not of the centerless type shown in FIG. 4.

The system according to the instant invention therefore allows not only the internal and external surfaces of a workpiece to be ground simultaneously, and about the same center, but also allows the two sides or axial ends of the workpiece similarly to be ground simultaneously about the same center. When such a method is used on a machine part such as a bearing journal it is therefore possible to work to high tolerances.

I claim:

1. A grinding apparatus for simultaneously machining internal and external surfaces of both ends of a tubular workpiece, the apparatus comprising:

a base;

means including a double-membrane hydraulic chuck of the centerless type on said base annularly surrounding said workpiece for supporting said workpiece between its ends for rotation about an axis passing through said ends;

drive means connected through said chuck to said workpiece for rotating same about said axis;

respective first grinder means on said base at each axial end of said chuck means and engaging therein for grinding respective internal surfaces of the ends of said workpiece in said chuck means;

respective second grinder means on said base to each axial side of said chuck means for grinding respective external surfaces of the ends of said workpiece in said chuck means while said first grinder means are grinding said internal surfaces of the ends of said workpiece; and securing means for retaining both of said grinder means releasably on said base at the respective axial ends of said workpiece adjacent said chuck means.

2. The apparatus defined in claim 1, further comprising slide means for displacing said chuck means relative to both said grinder means.

3. The apparatus defined in claim 1 wherein both of said grinder means have a grinding tool having a surface engaging said workpiece at a point and moving at said point oppositely to said workpiece at said point.

* * * * *